US006460538B1

(12) United States Patent
Kemp

(10) Patent No.: US 6,460,538 B1
(45) Date of Patent: Oct. 8, 2002

(54) EMERGENCY ESCAPE BREATHING APPARATUS

(75) Inventor: Martin Kemp, Ash, Nr. Aldershot (GB)

(73) Assignee: Protector Technologies B.V., An Schiedam (NL)

( * ) Notice: Subject to any disclaimer, the term of this patent is extended or adjusted under 35 U.S.C. 154(b) by 0 days.

(21) Appl. No.: 09/508,403

(22) PCT Filed: Sep. 14, 1998

(86) PCT No.: PCT/GB98/02779

§ 371 (c)(1),
(2), (4) Date: Mar. 10, 2000

(87) PCT Pub. No.: WO99/13946

PCT Pub. Date: Mar. 25, 1999

(51) Int. Cl.[7] ..... A62B 17/04; A62B 18/00

(52) U.S. Cl. ..... 128/201.22; 128/201.23; 128/201.29

(58) Field of Search ..... 128/201.15, 201.17, 128/201.22, 201.23, 201.24, 201.25, 201.29, 285.27, 206.12, 206.14, 206.21, 206.23, 206.24, 206.28, 207.11

(56) References Cited

U.S. PATENT DOCUMENTS

| | | | | | |
|---|---|---|---|---|---|
| 4,231,359 | A | * | 11/1980 | Martin | 128/201.18 |
| 4,466,432 | A | * | 8/1984 | Wise | 128/201.23 |
| 4,627,431 | A | * | 12/1986 | Werjefelt | 128/201.25 |
| 4,683,880 | A | * | 8/1987 | Werjefelt | 128/201.23 |
| H805 | H | * | 8/1990 | Schriver et al. | 128/201.22 |
| 5,146,636 | A | * | 9/1992 | De La Pena | 128/201.25 |
| H1316 | H | * | 6/1994 | McGuinness | 128/201.15 |
| 5,555,879 | A | * | 9/1996 | Helin et al. | 128/200.28 |
| 5,819,728 | A | * | 10/1998 | Ritchie | 128/201.22 |

FOREIGN PATENT DOCUMENTS

| | | | | |
|---|---|---|---|---|
| EP | 0470791 A2 | * | 12/1992 | |
| FR | 2614538 A1 | * | 11/1988 | |
| GB | 2301039 | | 11/1996 | A62B/17/04 |
| WO | 9005565 | | 5/1990 | A62B/17/04 |

* cited by examiner

*Primary Examiner*—Aaron J. Lewis
*Assistant Examiner*—Darwin P. Erezo
(74) *Attorney, Agent, or Firm*—Volpe and Koenig, P.C.

(57) ABSTRACT

A hood, particularly for an emergency escape breathing apparatus and having a box-like appearance, comprises generally planar front and rear panels left and right side panel and a top panel. The panels are made from flexible material, but the box-like shape is maintained by stiffening the front and rear panels by stiffening means. The front panel is formed with a transparent visor. Breathable gas is supplied to the hood via a valve attached to a fitting on the front panel.

14 Claims, 1 Drawing Sheet

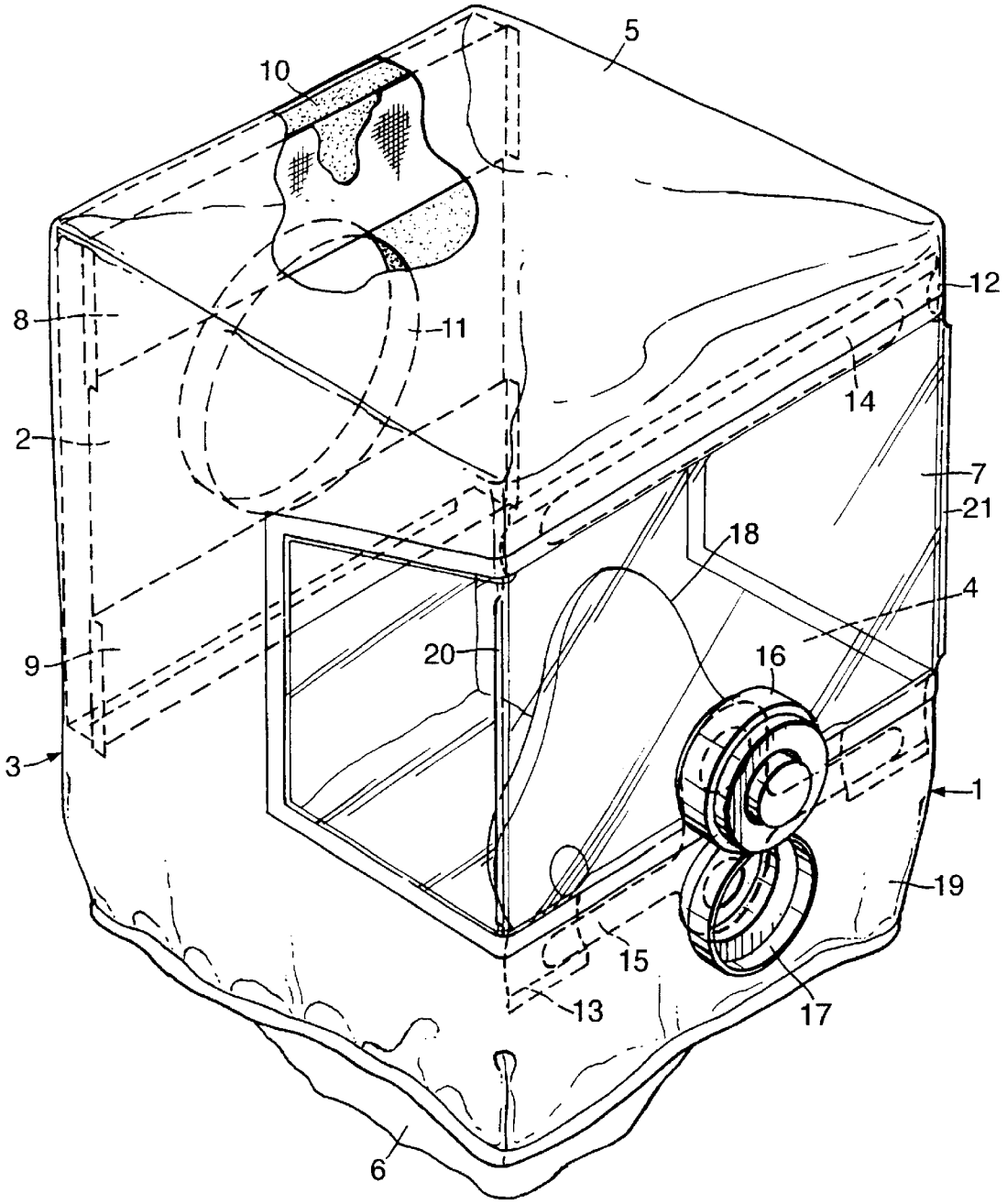
5
10
12
8
11
14
2
7
21
18
4
20
16
9
3
1
19
15
13
17
6

EMERGENCY ESCAPE BREATHING APPARATUS

BACKGROUND

This invention relates to emergency breathing apparatus which is intended primarily for use in effecting an escape from a polluted environment such as might arise as a result of natural disasters, industrial accidents, fires, or any situation where toxic substances such as gases, aerosols or powder are present in the atmosphere.

Emergency escape breathing apparatus generally comprises a flexible hood which, in use, is placed over the head, a source of breathable gas, such as compressed air, and a flexible tube passing between the two. In use, a valve is used to open the source of gas which passes up the tube to the hood, where it is breathed by the user. The source is generally designed to give a fairly limited supply of gas, typically lasting just 10 or 15 minutes, but sufficient to enable the user to escape to a place of safety.

The flexible hood normally has a neck seal which surrounds the neck of a wearer and prevents the ingress of the polluted atmosphere into the interior of the hood. The neck seal also permits the escape of gases from the interior of the hood where an increased pressure, greater than atmospheric pressure, tends to build up due to the continued supply of air, or other breathable gas to the hood. The hood may include a separate exhale valve for limiting the gas pressure increase within the hood.

With the device described above, it is known for the breath of someone wearing the hood to be exhaled into the interior of the hood. This tends to increase the proportion of carbon dioxide inside the hood to a level which makes it undesirable for the air inside the hood to be inhaled. This is despite the fact that fresh air is being supplied continually to the interior of the hood and that $C0_2$ contaminated air continually escapes from the interior of the hood to the atmosphere. A known method of overcoming this problem is to use a baffle or other physical barrier (which often takes the form of an orinasal mask or half-mask) to provide a confined space around the wearer's nose and mouth from which exhaled breath is expelled and to which the new air or other breathable gas is supplied. Where the barrier takes the form of an orinasal mask or half-mask, difficulties are often experienced by the wearer in donning the mask and successfully positioning and maintaining the mask correctly, during use.

Once the hood is in place and air is being supplied, the action of inhalation and exhalation tends to cause the hood to expand and contract in a cyclic manner, thus causing almost continuous movement of the hood material. Thus the visor—that part of the hood which is made of transparent flexible material and through which the user looks—is continually moving and this provides a distraction as a result of the varying optical characteristics of the hood. Furthermore, if the user is a spectacle wearer, the movement of the hood material results in an intermittent movement of the spectacles which is irritating to the wearer.

GB-A-2301039 describes a hood for an emergency escape breathing apparatus which utilizes a semi-rigid member incorporated into the fabric of the hood at the front which serves the dual purpose of maintaining the hood away from the wearer's face as the apparatus is donned and urging the orinasal mask against the user's face once the hood is in place

SUMMARY

In accordance with the present invention there is provided a hood for a breathing apparatus, said hood being formed from a plurality of panels of flexible material, said panels comprising front and rear panels joined by left and right side panels and a top panel, wherein said front and rear panels incorporate stiffening means for rendering the front and rear panels semi-rigid, and wherein the front panel incorporates a transparent portion forming a visor, and connection means for connecting the interior of the hood to a source of breathable gas.

Each panel may be formed of a single sheet of said flexible material which is joined around its edges to adjacent panels to form the hood. However, the number of joins may be reduced by forming two or more adjacent panels from a single sheet of material which is suitably cut and folded or creased to define the individual panels.

It is anticipated that the individual panels of the hood will be principally planar so that the angle between individual panels, when the hood is in its normal "as worn" shape is approximately 90°, thus giving a generally box-like appearance to the hood. The rear panel may also be generally planar, and approximately parallel to the front panel, but may alternatively have a more curved shape to more closely follow the back of a wearer's head.

The hood thus comprises semi-rigid front and rear panels joined by left and right side panels and a top panel. If the side and top panels are left flexible then the hood can act in the manner of a bellows during the above-mentioned cyclic expansion and contraction when breathing. In other words, the relatively rigid front and back panels tend to keep their shape during inhalation and exhalation, the changes in volume of the hood being taken up by flexure of the side and top panels. This means that the visor, in particular, maintains its shape during use and does not distort. in an embodiment, the visor extends right across the full width of the front panel, and out into the left and right side panels, thus extending the user's field of vision. In this case, that part of the visor which is formed by the left and right side panels will flex during breathing but, as this is at the periphery of vision, the disadvantageous effects of the flexing will not be too intrusive.

The stiffening means may take any convenient form. For the rear panel a pad of closed cell foam material may be attached to the panel for this purpose. The pad, typically about 1 cm thick, may be attached to the inside surface of the rear panel by adhesive, but preferably the pad is removably located in a suitable pocket or pockets. In the preferred embodiment, the pad includes a depression or through-hole designed to locate the back of the wearer's head. The use of a foam pad in this way allows the hood to comfortably and effectively fit a reasonable range of head sizes.

A similar pad could be used to stiffen the front panel but, because of the special requirements of the front panel—visor, air fittings—alternative methods are preferred. In the preferred embodiment, stiffening of the front panel is achieved by means of a pair of stiffening members which are attached to the material of the front panel, one above the visor and one below. The stiffening members extend across a substantial part of the width of the front panel and, in the case of the lower stiffening member, may also have a portion to which the connection means is attached. The stiffening members are made of rigid or semi-rigid material and preferably are resilient. Examples are spring steel or rigid but resilient plastics material.

The stiffening members may be attached to the material of the front panel by any suitable means but a suitably shaped fabric pocket on the inside surface is the preferred method.

In the preferred embodiment, an orinasal mask is fitted on the inside of the front panel immediately behind the gas connection means and is arranged so as to cover the wearer's nose and mouth during use of the hood. The orinasal mask thus defines a sub-chamber within the hood, although there are connections between the orinasal mask and the hood to allow a limited exchange of gas therebetween.

The underside of the hood may be left open, but it is preferred to provide an elastic neckband which seals around the wearer's neck to thus define a substantially sealed:interior, when in use, and thus protects the wearer from the surrounding atmosphere, which may not be breathable.

BRIEF DESCRIPTION OF THE DRAWLING(S)

In order that the invention may be better understood, an embodiment thereof will now be described by way of example only and with reference to the accompanying drawing which is a perspective view of a hood for an emergency escape breathing apparatus according to the invention, partly broken away to show the construction.

DETAILED DESCRIPTION OF THE PREFERRED EMBODIMENT(S)

Referring to the drawing, the hood comprises a box-like structure having front and rear panels 1,2, left and right side panels 3 and 4, and a top panel 5. As used in the specification and claims, the terms front, rear, left, right, top and bottom are defined from the perspective of a person facing the front of the hood. The panels are made from flexible material and are joined by welded seems at their edges. The bottom of the hood comprises a neck portion 6 which is made of elastic material of the panels needs to be flexible, but not necessarily elastic; indeed, a non-elastic material is currently preferred.

The front panel partly comprises a portion 7 of flame retardant transparent plastics material which serves as a visor. As can be seen, the visor extends right across the width of the front panel 1 and into the left and right side panels 3,4. The material used for the remaining parts of the front and side panels, and the rear and top panels is an opaque material, and is preferably flame retardant. A suitable material is polyurethane coated viscose.

In practice, the visor may conveniently be made from a single sheet of transparent plastics material which is creased at 20 and 21 to form the junction between the front panel 1 and the respective side panel 2 or 3. A permanent crease is preferred, rather than just a fold, so that the visor material, and hence the front panel itself, holds its shape. This can be achieved by initially folding the visor material back on itself in the appropriate position and then welding along the fold at a position slightly back from the fold itself so that a line of weld is formed immediately adjacent the fold. This effectively converts the fold into a permanent crease having stiffness and self-supporting characteristics which help the visor to retain its shape in use.

Located in a pair of pockets 8,9 on the inside surface of the rear panel 2 is a pad 10 of semi-rigid closed-cell plastics foam material. The central part of the pad is exposed to the hood interior to reveal an aperture 11 in the pad which, during use, locates the rear part of the hood against the wearer's head.

The purpose of the pad 10 is to stiffen the rear panel sufficiently that it substantially holds its shape during use. In this case this "shape" is planar, but it is possible that chamfers or similar could be formed at the edges so as to conform the overall shape of the hood more to the shape of the head, giving a perhaps better appearance.

The front panel 1 is also stiffened for the same reason, but the method of stiffening is different. In this case, elongate pockets 12,13 are formed above and below the visor 7, on the inside surface of the material of the front panel. These pockets extend across the panel 1 over most of its width and contain respective stiffening members 14, 15 which serve to provide the required stiffening of the front panel. The stiffening members take the form of strips made of spring steel, but other materials may be suitable.

The central part of the lower stiffening member 15 is extended above and below as shown and mounts two fittings 16 and 17. The lower fitting 17 is a standard fitting for the connection of a breathable gas from a cylinder (not shown) via a flexible line (also not shown). The upper fitting 16 is an optional exhale valve—again a standard fitting—which allows waste gases to be vented to atmosphere. Both the gas fitting 17 and exhale valve 16 connect to the interior of an orinasal mask 18 which is mounted on the interior side of the front panel 1 on the extension of the stiffening member 15. The use of an orinasal mask is conventional in such equipment and will not be described further.

The bottom part 19 of the front panel 1 is formed with a shallow chamfer, to improve the frontal appearance of the hood.

In summary, the hood comprises approximately planar and semi-rigid front and rear panels 1,2 joined by side panels 3,4, top panel 5 and neck portion 6 of non-stiffened flexible material. This configuration has a number of advantages, both when the hood is in use, and when not in use.

When not in use, the hood can be readily packed in such a way as to avoid crumpling the visor material. To achieve this, the side and top panels are simply pushed in so that the front and rear panels concertina together, forming a flat pack which can be easily stored without disturbing too much the planar shape of the front and back panels and, in particular, the front part of the visor. Conventional hoods tend to be crumpled up haphazardly during packing, leaving the visor with deep, semi-permanent folds which impair clear vision out of the hood.

When in use, and on a wearer's head, the hood is supported on the head primarily at the front by the close fitting of the flexible orinasal mask 18 over the nose and mouth and at the rear by the fitting of the back of the user's head into the aperture 11 in the pad 10. As already explained, during breathing from the air supply, the amount of air in the hood, and therefore the volume of the hood, rises and falls in a cyclic manner approximately in time with breathing. Thus, during use, the hood is constantly being partly inflated and partly deflated, like a balloon. In the case of the above-described mask, the changes in volume resulting from this are taken up primarily by the side and top panels 3,4 and 5 and the neck portion 6, which move inwards and outwards in the manner of bellows, leaving the semi-rigid front and rear panels relatively undisturbed. In particular, the material of that part of the visor 7 which is formed by the front panel 1 is relatively undisturbed by the movement and the optical characteristics of the front part of the visor remain relatively constant, thus improving the quality of vision through the visor. Those parts of the visor which are formed by the side panels 2,3 will be subject to the breathing movement, as described above, but since these areas are in the user's peripheral vision, the degradation in optical properties is less of a problem.

Also, for users wearing spectacles, the lack of motion of the front panels, and its semi-rigid nature ensures not only that the hood material is kept, as far as is practicable, spaced from the wearer's spectacles, but also that the spectacles are not constantly catching the material of the hood and being moved about, which is very distracting. Furthermore, when donning the hood, its cubic shape tends to keep it clear of spectacles so that they are less likely to be dislodged.

Although the hood has a box-like appearance, the "box" does not need to be strictly rectangular. For example although the side panels 3,4 are shown generally parallel to each other, they do not need to be so. Likewise the top panel 5 could slope forwardly or backwardly.

What is claimed is:

1. A hood for breathing apparatus, said hood being formed from a plurality of panels of flexible material to define a partial enclosure for a wearer's head having an interior, said panels comprising front and rear panels joined by left and right side panels and a top panel, wherein said front and rear panels incorporate stiffening means for rendering the front and rear panels semi-rigid, and wherein the front panel incorporates a transparent portion forming a visor, and connection means for connecting the interior of the hood to a source of breathable gas.

2. A hood is claimed in claim 1 wherein each panel is formed of a single sheet of said flexible material which is joined around its edges to form the hood.

3. A hood as claimed in claim 1 wherein two or more adjacent panels are formed from a single sheet of material which is cut and folded or creased to define said two or more adjacent panels.

4. A hood as claimed in claim 1 wherein the individual panels of the hood are generally planar.

5. A hood as claimed in claim 1 wherein said transparent portion which forms the visor extends across the full width of the front panel and partially into the left and right side panels.

6. A hood as claimed in claim 1 wherein the stiffening means for the rear panel comprises a pad of foam material attached to the panel.

7. A hood as claimed in claim 6 wherein said foamed material is a closed cell foam material.

8. A hood as claimed in claim 6 wherein the pad includes a depression or through-hole.

9. A hood as claimed in claim 1 wherein the stiffening means for the front panel comprises one or more elongated members of rigid or semi-rigid material which are attached to the front panel.

10. A hood as claimed in claim 1 wherein the material of the one or more elongated members is also resilient.

11. A hood as claimed in claim 9 wherein two stiffening members are located respectively above and below the visor.

12. A hood as claimed in claim 11 wherein the stiffening member which is below the visor further incorporates a portion by which it is attached to the connection means.

13. A hood as claimed in claim 1 wherein an orinasal mask is fitted on the front panel immediately behind the connection means.

14. A hood as claimed in claim 1 further including an elastic neckband attached to the bottom edges of the front, rear and side panels, and arranged, in use, to seal around a wearer's neck to thus define a substantially sealed interior.

* * * * *